US010895164B2

(12) United States Patent
Gaia et al.

(10) Patent No.: US 10,895,164 B2
(45) Date of Patent: Jan. 19, 2021

(54) METHOD AND DEVICE FOR REDUCING LEAKAGE LOSSES IN A TURBINE

(71) Applicant: TURBODEN S. p. A., Brescia (IT)

(72) Inventors: Mario Gaia, Brescia (IT); Roberto Bini, Brescia (IT)

(73) Assignee: TURBODEN S.P.A., Brescia (IT)

( * ) Notice: Subject to any disclaimer, the term of this patent is extended or adjusted under 35 U.S.C. 154(b) by 161 days.

(21) Appl. No.: 16/066,619

(22) PCT Filed: Jan. 18, 2017

(86) PCT No.: PCT/IB2017/050256
§ 371 (c)(1),
(2) Date: Jun. 27, 2018

(87) PCT Pub. No.: WO2017/125858
PCT Pub. Date: Jul. 27, 2017

(65) Prior Publication Data

US 2019/0024524 A1 Jan. 24, 2019

(30) Foreign Application Priority Data

Jan. 20, 2016 (IT) ..... 102016000004361

(51) Int. Cl.

| | |
|---|---|
| ***F01D 11/06*** | (2006.01) |
| ***F01D 11/10*** | (2006.01) |
| ***F01D 11/04*** | (2006.01) |
| ***F01D 11/02*** | (2006.01) |
| ***F01D 11/00*** | (2006.01) |
| ***F01D 11/08*** | (2006.01) |

(52) U.S. Cl.
CPC ..... *F01D 11/06* (2013.01); *F01D 11/001* (2013.01); *F01D 11/02* (2013.01); *F01D 11/04* (2013.01); *F01D 11/08* (2013.01); *F01D 11/10* (2013.01); *F05D 2240/55* (2013.01); *F05D 2260/2322* (2013.01)

(58) Field of Classification Search
CPC ..... F01D 11/001; F01D 11/02; F01D 11/04; F01D 11/06; F01D 11/08; F01D 11/10
See application file for complete search history.

(56) References Cited

U.S. PATENT DOCUMENTS 2,972,470 A * 2/1961 McCormick ..... F01D 11/008 415/190
3,057,542 A * 10/1962 Keenan ..... F01D 25/18 415/180
3,642,292 A * 2/1972 Dougherty ..... F01D 11/04 277/347

(Continued)

*Primary Examiner* — J. Todd Newton
*Assistant Examiner* — Andrew J Marien
(74) *Attorney, Agent, or Firm* — R. Ruschena, Patent Agent, LLC

(57) ABSTRACT

A method for reducing the leakage of an organic working fluid operating within a turbine (10) of an Organic Rankine Cycle system, the method comprising the injection of a fluid flow rate (Q) into a volume (I) at a static pressure lower than the total pressure (P1) upstream of the turbine and located near of at least one labyrinth seal (L1, L11) of at least one stage of the turbine (10), said fluid flow rate (Q) having an initial exergetic content lower than the initial exergetic content of the organic working fluid located inside the turbine and flowing through said labyrinth seal (L1, L11).

22 Claims, 7 Drawing Sheets

(56) References Cited

U.S. PATENT DOCUMENTS

| | | | | |
|---|---|---|---|---|
| 4,311,431 | A * | 1/1982 | Barbeau | F01D 5/225<br>415/116 |
| 5,157,914 | A * | 10/1992 | Schwarz | F01D 5/081<br>415/115 |
| 9,920,652 | B2 * | 3/2018 | Suciu | F01D 25/14 |
| 2010/0071368 | A1 * | 3/2010 | Kaplan | F01K 7/18<br>60/651 |
| 2011/0072832 | A1 * | 3/2011 | Blanchard | F01D 5/082<br>60/806 |
| 2014/0363268 | A1 * | 12/2014 | Gaia | F01D 1/04<br>415/1 |
| 2016/0108751 | A1 * | 4/2016 | Hogg | F01D 11/04<br>415/1 |

* cited by examiner

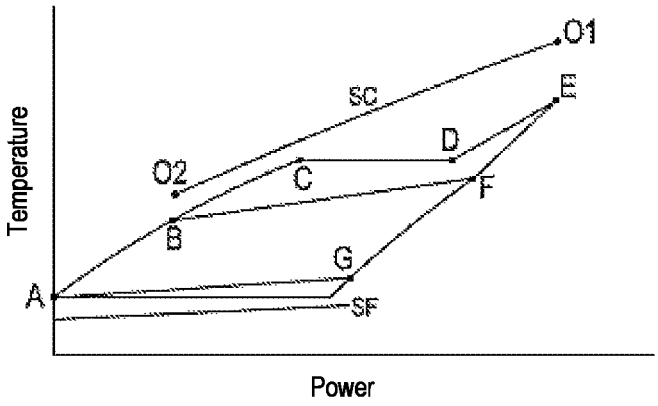
FIG.6a
FIG.6b
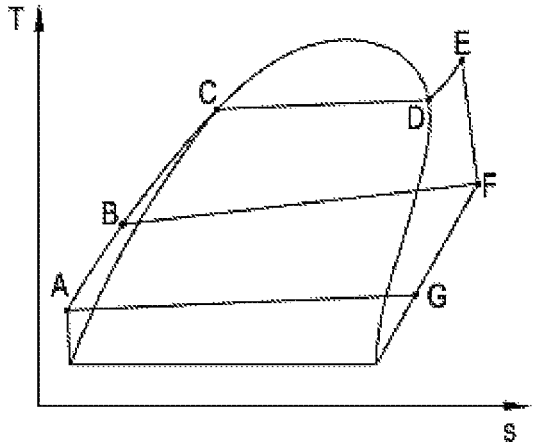
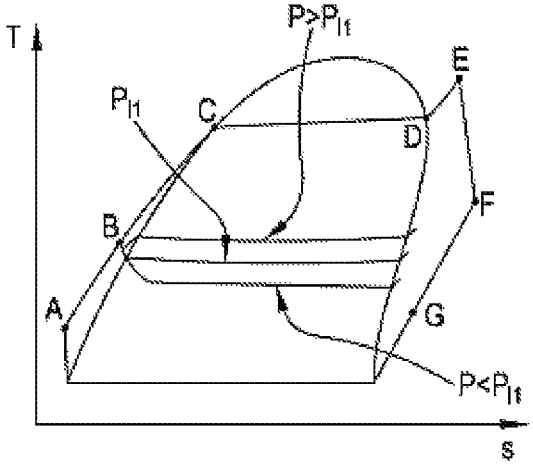
FIG.7

METHOD AND DEVICE FOR REDUCING LEAKAGE LOSSES IN A TURBINE

RELATED APPLICATIONS

This is a national stage application of PCT application PCT/IB2017/050256 having an international filing Date of Jan. 18, 2017. This application claims foreign priority based on application Ser. No. 10/2016000004361 of Italy, filed on Jan. 20, 2016.

BACKGROUND OF THE INVENTION

1. Field of the Invention

The present invention relates to a method and a device suitable to reduce the losses due to leakage of fluid in a turbine. The turbine is used for the expansion phase of vapor in thermodynamic cycles and is particularly suitable for an organic Rankine cycle (in the following, also an ORC cycle).

2. Brief Description of the Prior Art

As known, a finite sequence of thermodynamic (for example isothermal, isochoric, isobaric and adiabatic) transformations, is defined as a thermodynamic cycle, at the end of which the system returns to its initial state. In particular, an ideal Rankine cycle is a thermodynamic cycle comprising two adiabatic transformation and two isobars, with two phase changes, from liquid to vapor and from vapor to liquid. Its purpose is to transform heat into work. Such cycle is generally adopted principally in thermal power plants for the production of electrical power and uses water as working fluid, both in liquid and vapor form, with the so-called "steam turbine".

More specifically, organic Rankine cycles (ORC) have been designed and realized which use high molecular mass organic fluids for the most different applications, in particular also for the exploitation of thermal sources with a low-average enthalpy content. As in other vapor cycles, the plant for an ORC cycle includes one or more pumps for supplying the organic working fluid, one or more heat exchangers to realizing the preheating, vaporization and possible overheating or heating stages in supercritical conditions of the same working fluid, a vapor turbine for the expansion of the fluid, mechanically connected to an electric generator or a working machine, a condenser which returns the organic fluid in the liquid state and possibly a recuperator for recovering the heat downstream of the turbine and upstream of the condenser.

Particular attention is paid to the proper functioning of the turbine since the ORC efficiency, as well as also of a traditional water steam cycle, greatly depends on the amount of mechanical work which the turbine is able to process. One of the major sources of loss in a turbine is represented by internal leakages, or by the vapor or gas flow rate which is not processed by the blades, due to clearance between stator and rotor parts.

One of the traditional ways to limit this type of losses consists in the adoption of labyrinths, or zones with reduced distance between the stator and the rotor parts, in which tortuous paths are also present in correspondence of said axial or radial clearances: in this way the flow rate of working fluid leaking from the clearances is limited by the load loss caused by the labyrinths. Different types of labyrinths are known, among which sliding or not sliding systems are mentioned, with or without honeycomb structures which can be abraded by sliding and other types of rigid structures but always consisting of abradable materials, or with very reduced cross sections in order to limit damages in case of a contact.

Labyrinth seals are an effective tool, but cannot cancel the leakages. The amount of fluid leakage depends on many factors (in particular on the involved pressures). Such leakage can correspond in some cases to 10% of the power produced by the turbine and is mainly localized in the first one or ones stages of the machines, where the pressures are higher and the blade heights are smaller: in fact, the same gap is more or less significant depending on the blade heights, as it has a different percentage weight.

FIG. 1 is a detail of the high-pressure stages of a axial turbine 1 according to the known art. As will be discussed below, however what will be explained later can be extended to any type of axial, radial (centripetal or centrifugal) or mixed radial/axial turbine. FIG. 2 shows a detail of the first stage, still according to the known art.

The vapor of the organic working fluid enters the turbine with the evaporation pressure P1. The vapor is accelerated in the first stator S1 and is guided towards the rotor blades R1, where it generates mechanical power. The vapor pressure decreases from one stage to the other, until reaching at the exit of the turbine, a pressure value near to the condensation pressure. In particular, still in the first stator a strong reduction of the fluid pressure occurs: the relationship between the inlet pressure P1 in the stator S1 and outlet pressure PI1 from the same first stator stage, can also be greater than 2, i.e. the stator works as a nozzle with a sonic block. As is known, the power associated to the decrease of the static pressure is converted in a dynamic pressure, i.e. in speed. In other words, between the upstream and downstream side of the stator, under adiabatic and isentropic conditions the total pressure (the sum of static and dynamic pressure) is preserved.

In such conditions, temperature and total enthalpy are also preserved in the stator, being by definition an adiabatic duct.

The accelerated vapor rate flow from the stator S1 will preferably move towards the rotor R1, but a portion of the same will directly flow downstream of the rotor R1 by passing through the labyrinths L2 placed at the top of the blades and a portion (corresponding to the flow rate $Q_{TRAF}$ will instead flow through the labyrinths L1 placed closer to the axis of rotation. While the leakage occurring at the top of the blades is not entirely "lost" as the fluid which "bypasses" the first rotor stage can still provide a mechanical work for the subsequent stages, the leakage through the labyrinths L1 is particularly severe when at the top of such labyrinths an upstream PI1 a downstream pressure $P_{COND}$ are present, as it often occurs in practice (the leaked flow rate, leading directly to the condenser can no longer produce a work).

Some solutions have been sought to the problem (which are cited for example in WO2014/191780 A1 and WO2012/052 740 A1) in order to reduce as much as possible the leakage losses from the turbine. In other words, instead of trying to limit the leakage losses by reducing the flow rate of the leaked fluid, the present invention aims to reduce as much as possible the energy content of the exiting fluid exiting due to leakage.

SUMMARY OF THE INVENTION

Aim of the present invention is to devise a method permitting to minimize the energy content of leakage losses of the organic fluid passes through the stages of a turbine and, consequently, to increase the efficiency of the turbine of a few percentage points.

The method according to the present invention uses a fluid injection in a vapor or liquid phase or in the form of a two-phase fluid and has the features referred to in the independent method claims.

The injected fluid may preferably be the same organic working fluid drawn from the same plant. The concept of the present invention, as will be seen below, can however be extended to any fluid.

Another aim of the present invention is to provide a device suitable to implement the above method by allowing to realize the fluid injection within the turbine in the most advantageous areas.

The device according to the present invention is integrated in the expansion turbine having the characteristics set out in the independent product claim.

A further aim of the present invention is to configure the ORC cycle plant or a traditional water vapor so that it is suitable to generate a flow rate of a working fluid, which is vaporized or is still in the liquid phase and can be injected into the turbine. This is done by providing the plant with an additional heat exchanger, as set out in the annexed plant claim.

Further ways of implement the aforesaid method and device, suitable to reduce the fluid leakage losses in a turbine, which are preferred and/or particularly advantageous, are described according to the features set out in the annexed dependent claims.

BRIEF DESCRIPTION OF THE DRAWINGS

The invention will now be described with reference to the accompanying drawings, which illustrate some examples of non-limiting embodiments, in which:

FIG. 6 shows a temperature-power diagram (FIG. 6*a*) and a temperature-entropy diagram (6*b*) of a typical organic Rankine cycle, FIG. 7 is a thermodynamic temperature-entropy diagram in which different laminating curves of the liquid are shown, which are used to generate the vapor to be injected into the turbine, FIG. 8 schematically shows a plant with an ORC cycle (FIG. 8*a*) and its corresponding temperature-power diagram (FIG. 8*b*), according to a further aspect of the present invention, FIG. 9 schematically shows a variant of the plant with an ORC cycle of the previous Figure (FIG. 9*a*) and its corresponding temperature-power diagram (FIG. 9*b*).

DETAILED DESCRIPTION OF THE INVENTION OR OF THE PREFERRED EMBODIMENTS

Figure 8A:
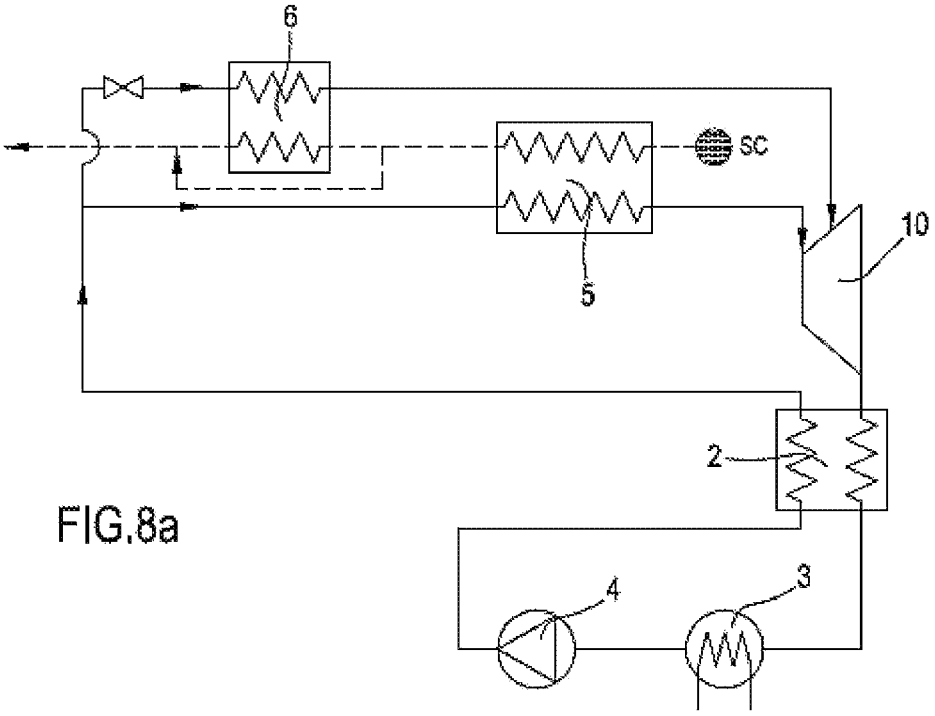

The invention relates to systems operating according to an organic Rankine cycle (ORC) or with a traditional water vapor as better explained at the end of the detailed description. In the following an ORC plant it more specifically described but similar arguments and conclusions can be obtained in the case of a traditional steam cycle. With reference to FIG. 8*a* which will be further described hereinafter for the purposes related to the present invention, a plant for ORC cycles, as is known, comprises at least a supply pump 4 for supplying an organic working fluid, in a liquid phase, to at least one heat exchanger 5. In the heat exchanger, which in turn can comprise a pre-heater, an evaporator and a super-heater, the organic liquid is heated until its transformation in the vapor phase and until its eventual overheating or it is hypercritically heated in case of a supercritical cycle. The heat is supplied by a hot source, for example a diathermic oil. At the outlet from the heat exchanger, the vapor passes through an expansion turbine 10 which produces the useful work of the cycle, i.e. the production of mechanical energy. The working fluid finally passes through a condenser 3 which brings it in the liquid phase in order to be supplied again by the pump 4 to the heat exchanger. Advantageously, in order to increase the effectiveness of the cycle, between the turbine 10 and the condenser 3 a recuperator 2 can be inserted, i.e. a heat exchanger which exchanges heat between the organic fluid in liquid phase which is pumped by the pump 4 towards the heat exchanger 5, and the organic fluid in a vapor phase which from the turbine 10 is directed toward the condenser 3.

Figure 4:
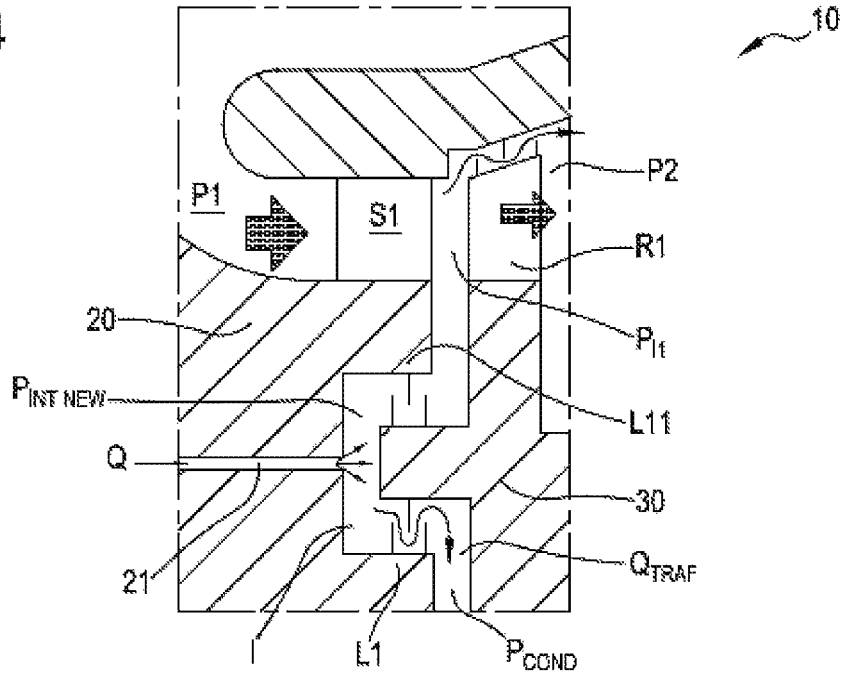
FIG. 4 shows a detail of the first high pressure stage of a turbine, according to an embodiment of the present invention.

FIG. 4 shows a detail of the first high pressure stage of the turbine 10, according to one aspect of the present invention.

The turbine 10 then includes a first row of stators S1 and a first row of rotors R1. The blades of the stator stage S1 are integral with the housing 20 of the turbine, while the blades of the rotor stage R1 are integral with a disc 30 of the turbine. The same turbine 10 also may include further rows of stators and row of rotors and can also be an axial, radial (centripetal or centrifugal) or a mixed radial/axial turbine. The description of the method and of the device according to the invention will be referred purely by way of example to the first high pressure stage, as in FIG. 4, as this is the stage in which the fluid pressure is highest and therefore the losses due to leakage are more considerable in terms of loss of turbine efficiency. Naturally all can be said about the first turbine stage can also be implemented in one or more successive stages, also in correspondence of the labyrinths placed between the turbine case and the top of the rotor blades. The organic fluid at the turbine inlet, and hence upstream of the stator S1 stage has a total pressure P1, downstream of the same stator stage (i.e. upstream of the first rotor stage R1), will have a lower static pressure PI1, whereas downstream of the first rotor stage R1, the fluid will have a further pressure reduction and the value of the static pressure is be equal to P2, then consequently P2<PI1<P1. The amount of the pressure reductions depends on the reaction of the turbine stage considered.

Figure 3:
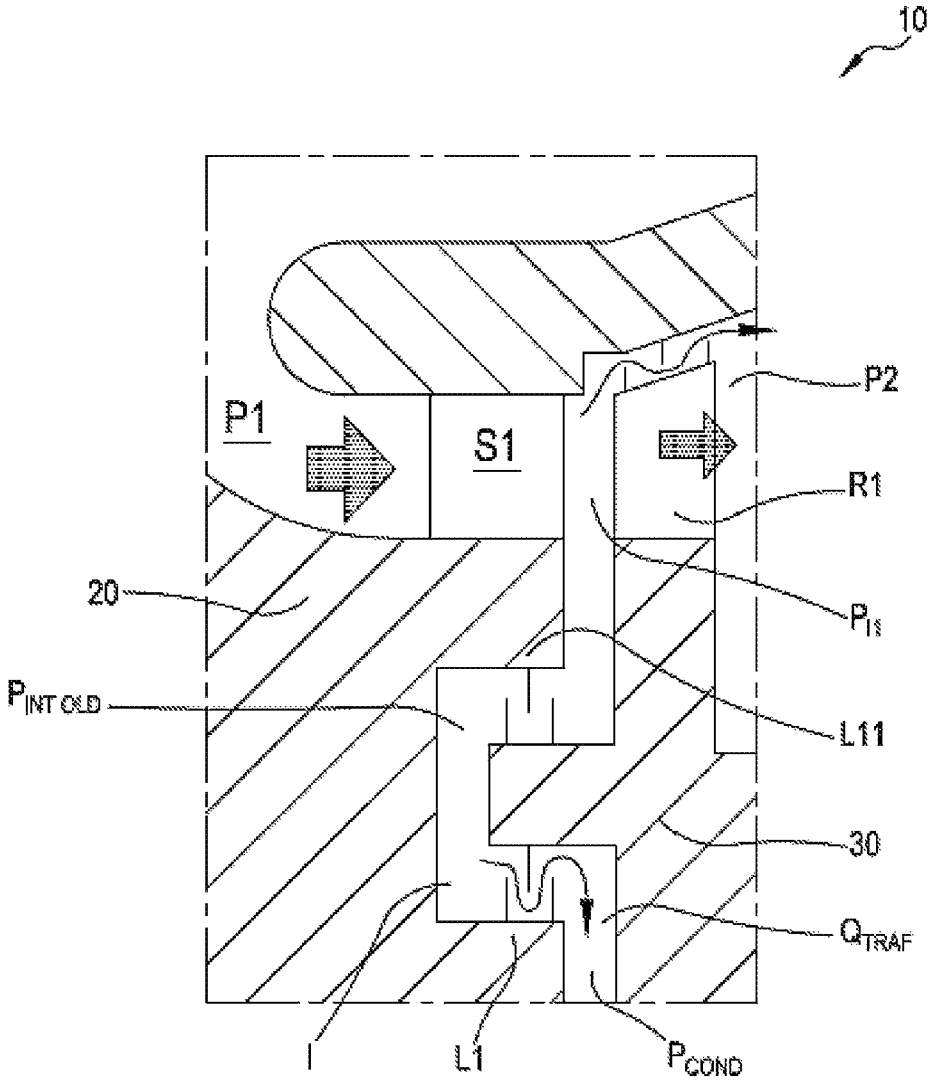
FIG. 3 is the same detail of FIG. 2, shown with a split labyrinth.

For the sake of simplicity, a labyrinth L11 is further considered, being identical to the L1 labyrinth (FIGS. 3 and 4), located upstream of L1. The volume between the two labyrinths will produce to a $P_{INTOLD}$ pressure, which is intermediate between PI1 and $P_{COND}$ and is such that the flow rate of fluid leaking into the labyrinth between the PI1 and $P_{INTOLD}$ pressures is equal to that leaking between the $P_{INTOLD}$ and $P_{COND}$. Let's now assume that a volume I is supplied between the two labyrinths with a fluid flow rate Q. Advantageously, the same working organic fluid could be used, the flow rate of which can be tapped, according to known methods and therefore it will be not described. For reasons of clarity, let us also assume that the fluid is present in the form, of vapor. The injection of fluid can take place by means of a duct 21 passing within the housing 20 of the turbine. The volume I into which the fluid is injected will be at a static pressure lower than the total pressure P1 upstream of the turbine.

Evidently if the volume in which the injection of the fluid flow rate Q occurs is placed in the vicinity of one stage of the turbine 10, different from the first stage, such a volume will be at a lower static pressure than the total pressure, upstream of the corresponding rotor of the turbine stage in which the injection occurs.

Figure 1:
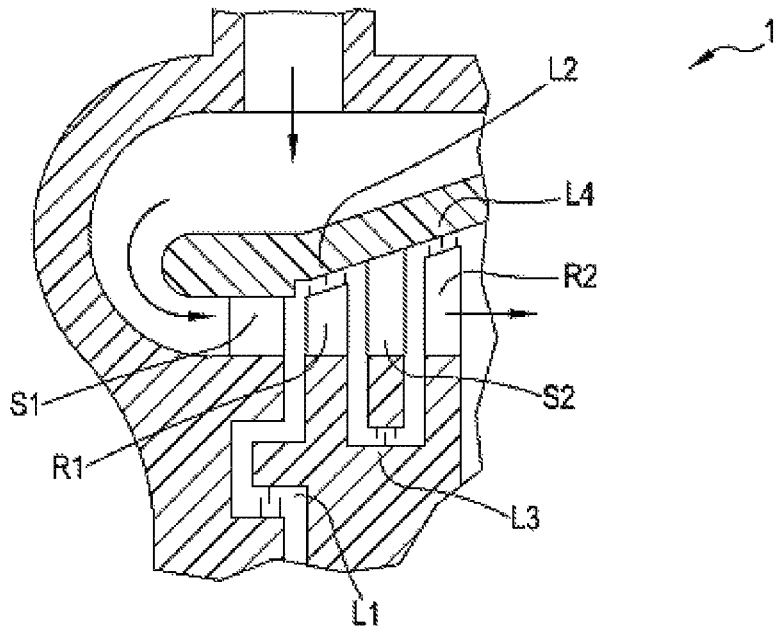
FIG. 1 is a detail of the high-pressure stages of an axial turbine according to the known art.
Figure 2:
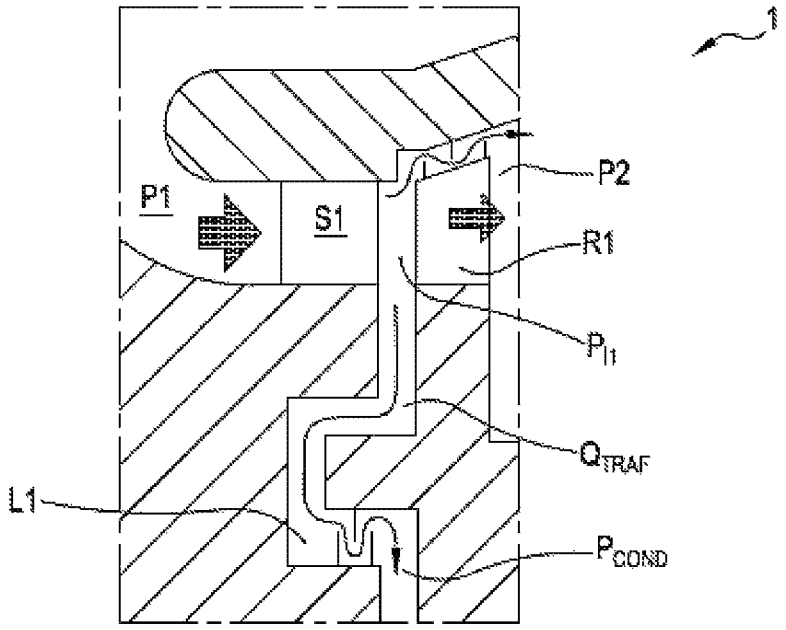
FIG. 2 is a detail of the first stage of the turbine, still according to the known art.

If the pressure $P_{INTNEW}$ reached in Volume I is exactly equal to PI1, the labyrinth L1 will be traversed by a vapor flow rate $Q_{TRAF}$ in practice identical to that which crossed it in the absence of the labyrinth L11, since the pressure difference upstream and downstream of L1 is the same as the case without injection (FIG. 2); also in this case the maze L11 will not be affected by any pressure difference and thus will not be crossed by any vapor flow.

It is noted that the flow rate may not be exactly identical to $Q_{TRAF}$ if the characteristics of the injected (superheated) vapor were not identical to those present in the same room in the absence of injection. However, this does not alter in any case the meaning and the scope of the present invention.

If the injection pressure is greater than PI1 instead, there will be a flow also through L11, directed towards the blades. Viceversa, if the pressure is lower than PI1, the flow rate crossing L11 will be directed towards the condenser. A small flow rate through the labyrinth L11 is still desirable to flow and cool L11 in case you accidentally slide between the rotating part and the stator one.

In any case, the labyrinth L11 is subjected to a zero pressure difference PI1−$P_{INTNEW}$ or otherwise a limited one, therefore L11 can be achieved with a less complex geometry with respect to L1.

Figure 5:
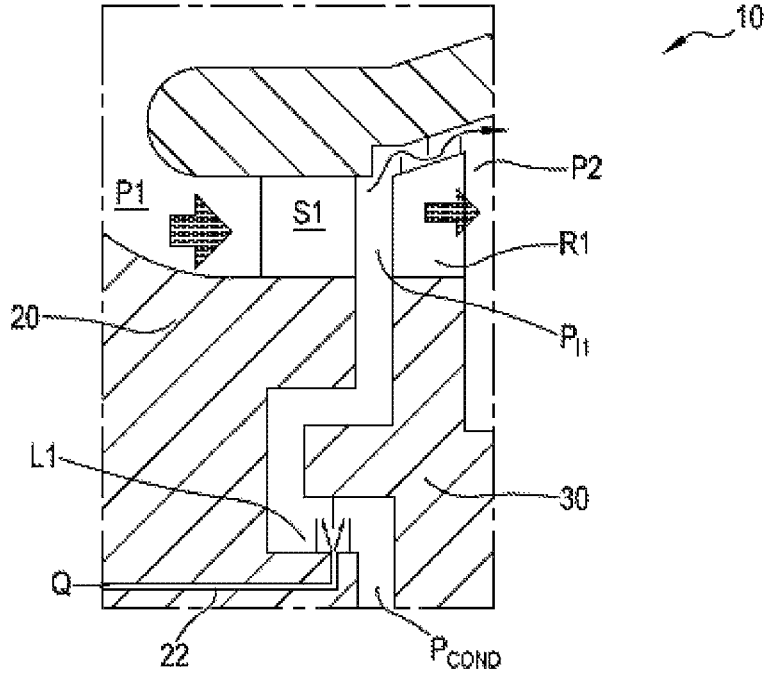
FIG. 5 shows a detail of the first high pressure stage of a turbine, according to a further embodiment of the present invention.
Figure 5A:
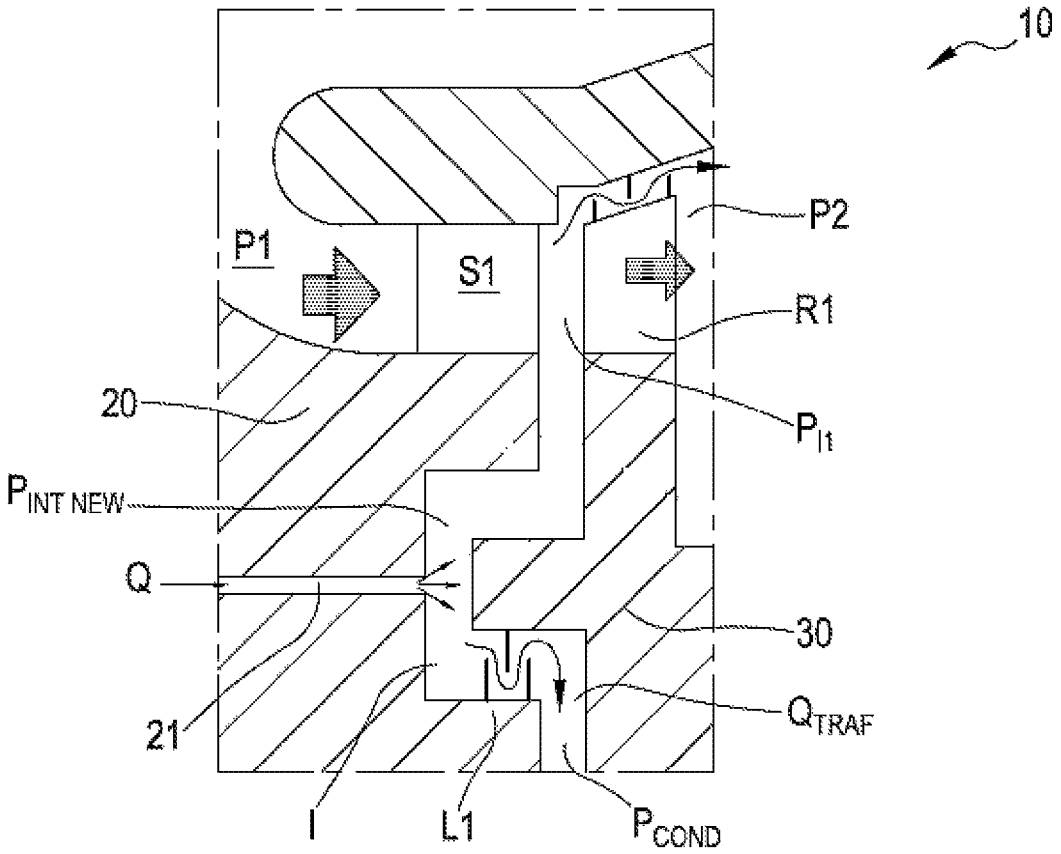
FIG. 5*a* shows a detail of the first high pressure stage of a turbine, according to a further embodiment of the present invention.

With reference to FIG. 5, the injection can take place directly within the labyrinth L1, through a conduit 22 which also passes through the housing 20 of the turbine, without the addition of a second group of labyrinths. Also, the injection can occur upstream of the single labyrinth L1, according to FIG. 5*a*.

It is now necessary to consider that, according to the present invention, it is possible to generate vapor of fluid (or working organic fluid) to be injected in the labyrinths in such a way that such a vapor is generated with a lower exergy original content (as it is known, the exergy of a system is the maximum fraction of energy that can be converted into mechanical work) lower than that of the vapor flowing through the labyrinth traditional turbine, so as to obtain a higher yield of the turbine and the overall thermodynamic cycle.

On FIG. 6 it is shown the temperature-power diagram (FIG. 6*a*) and the temperature-entropy (6*b*) of a typical ORC cycle. As it is known, the organic fluid receives heat from the high temperature source SC that consequently will lower its temperature, accomplishing the transformation thermodynamics from O1 to O2. In particular, the SC source releases heat to the organic fluid in BC (pre-heating), CD (evaporation) and D-E (overheating). The hot source can be diathermal oil or directly geothermal fluid or the combustion or recovery gases of water vapor. The turbine expands the fluid in EF, while the heat released in FG is transferred to AB (heat recovery), if a recuperator is present in the cycle. The further heat possessed by organic fluid is then transferred to a cold source SF (condensation).

The injection of the organic working fluid in the labyrinths can be made according to three different modes, all selected so as to obtain the desired improvement in performance of the turbine:

- first mode: injection of vapor to a pressure level $P_{INTNEW}$, next to the one present downstream of the first turbine stator (ie $P_{INTNEW}$≈PI1);
- second mode: injection of working fluid in the liquid state with generation of vapor in the vicinity of the labyrinths;
- third mode: injection of working fluid in the liquid state with the generation of a two-phase mixture in the vicinity of the labyrinths.

For simplicity reasons, in the following description, the embodiment will be considered with the single labyrinth L1 (as shown in FIG. 5), where the same considerations will be obviously applicable also in the case there is the presence of an additional labyrinth L11 (as illustrated in FIG. 4).

The first mode provides an injection into the vapor labyrinth to a next pressure PI1, i.e. the pressure downstream of the first stator; the vapor at this intermediate pressure is generally not available and must be specially generated. A solution is to draw off the organic fluid still in the liquid phase, for example at the outlet of regeneration B, laminate it and allow it to evaporate at a lower pressure in an additional heat exchanger (6 in FIG. 8*a*), by exploiting in the most convenient way the hot source SC.

The vapor production to an intermediate pressure level (for example equal to PI1) involves the absorption of a considerable power, but still at a lower temperature compared to the upstream vapor turbine conditions with a pressure P1. The vapor upstream of the labyrinth L1 is in both cases (with and without injection) near to the static pressure PI1, but in the case without injection it is located at a higher total enthalpy level, almost equal to that in the turbine inlet. Hence, the vapor used to "seal" the labyrinth has an energy content (total enthalpy) lower than that of the vapor that leaks normally from the labyrinth. Furthermore, the power produced for the vapor at the turbine inlet conditions (point E in FIG. 6) is greater than that required to produce the same amount of vapor to the pressure PI1: for example, if the point E is 250° C. and 25 bars and the working fluid is cyclopenthane, the enthalpy difference from the point B (liquid at 25 bar, 130° C.) necessary to produce respectively superheated vapor in the conditions of the point E and saturated vapor at a pressure equal than PI1, for example at 12 bar is 530 kJ/kg compared with 350 kJ/kg.

FIG. 7 is still a thermodynamic temperature-entropy diagram in which in addition to ORC cycle already illustrated in FIG. 6*b* are different possible choices of the lamination pressure are shown, at which to generate the vapor to be injected. The choice of the lamination pressure $P_{INTNEW}$ with respect to PI1, or if equal to PI1 or slightly higher or slightly lower is conditioned by the balancing of several factors:

- the higher the pressure, the lower the flow of "precious" vapor which leaks from the outlet from the stator to the condenser, but this implies the need to produce the "auxiliary" vapor at a higher temperature (FIG. 7, $P_{INTEW}$>PI1);

the more the pressure is low, the higher is the possibility that the "fine" vapor can leak towards the condenser, but it is possible to produce the "auxiliary" vapor at a lower temperature.

The level of laminating pressure in fact determines the overall efficiency of the plant.

Figure 8B:
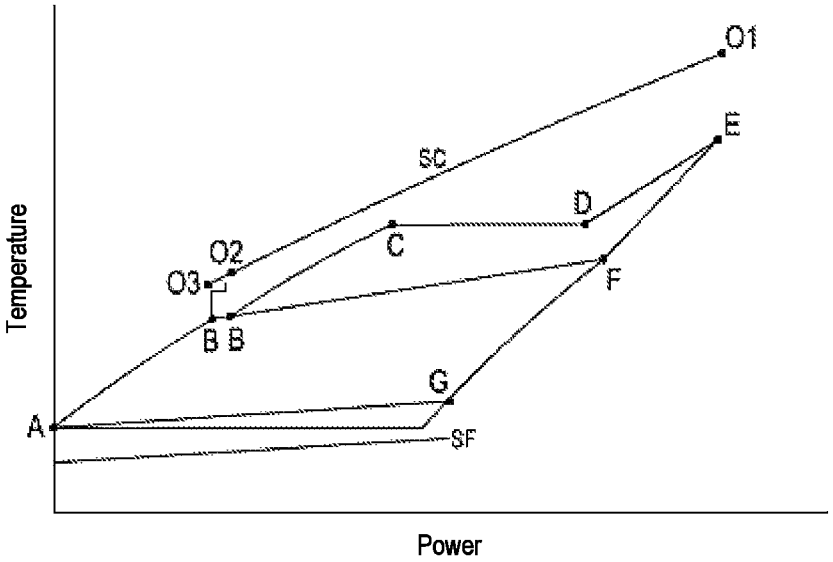

In fact, if the liquid is evaporated at a sufficiently low temperature, it is possible to further lower the temperature of the hot source (from O2 to O3), and then recover more heat, as described in FIGS. 8*a* and 8*b*. In this case, the low pressure vapor generation can be realized by an additional heat exchanger 6, fed downstream of the main heat exchanger 5.

Alternatively, with reference to FIG. 9, a certain flow rate Q1 of oil can be separated from the main circuit to a suitable intermediate temperature (in the example below about 200° C.) and with it in parallel with the additional heat exchanger 6.

Figure 9A:
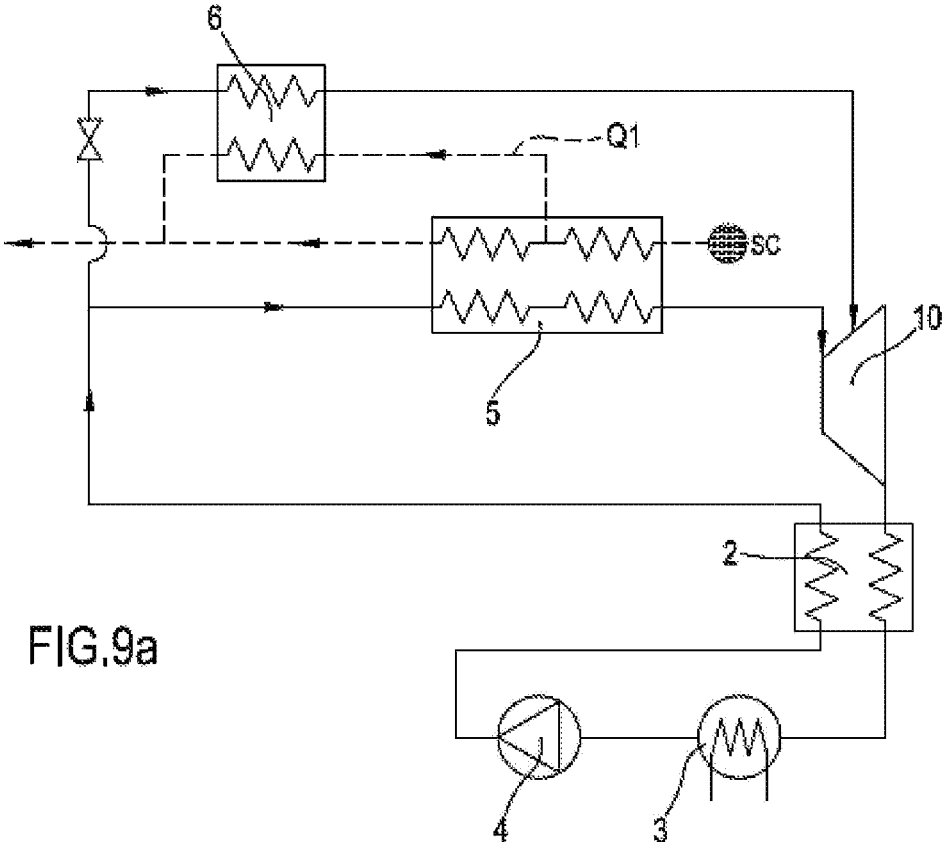
Figure 9B:
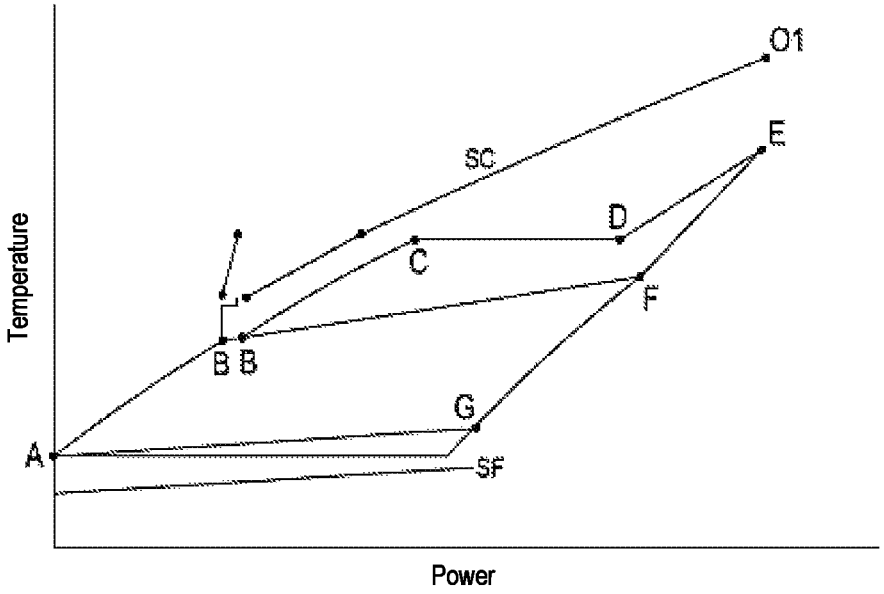

The solution of FIG. 9 is required when the oil temperature O2 is already very low (such as not to allow further heat recovery) or when the dimensioning of the additional heat exchanger 6 according to the diagram of FIG. 8 would lead to very large surfaces of exchange (in fact, according to the scheme of FIG. 9, the difference in temperature in the heat exchanger increases, then for the same power the exchanger has lower sizes and costs.

Table 1 shows the performance increase that can be achieved thanks to the subject of the patent system in a typical case of ORC application. The standard case (without application of the present invention, that is, according to the known art) refers to a plant of cyclopenthane, as represented in FIG. 6. The other two cases instead refer to the same plant in which the injection system has been implemented in the labyrinths, respectively according to the diagrams of FIGS. 8 and 9. The vapor turbine inlet conditions are 25 bar and 250° C., while the pressure PI1 in this example is equal to 12 bar; the hot spring is diathermic oil to 315° C.

TABLE 1

| Property | Standard | Injection (FIG. 8) | Injection (FIG. 9) |
|---|---|---|---|
| Texit oil (° C.) | 161 | 156 | 158 |
| Total thermal absorbed power (kW) | 22215 | 22787 | 22719 |
| Extra power absorbed for generation of steam to be injected (%) | / | 2.3 | 2.8 |
| Gross electrical power generated (kW) | 4801 | 5016 | 4973 |
| Gross efficiency (%) | 21.6 | 22.0 | 21.9 |

In the cited examples, the thermal power absorbed by ORC in cases with injection increases, but the increase of generated electric power is greater than that obtained with a simple increase in plant size, therefore the performance of the cycle increases.

Another way to highlight the efficiency of the system is to evaluate the increase of electric power obtained in relation to the increase of required thermal power. In the cases referred to the above example:

TABLE 2

| | Injection FIG. 8 vs standard | Injection FIG. 9 vs standard |
|---|---|---|
| ΔThermal power (kW) | +572 | +504 |
| Δ Electric power (kW) | +215 | +172 |
| Electric efficiency of the added part | 37.6 | 34.1 |

The performance values of the added power section are therefore clearly superior to the performance of the basic cycle (~35% vs ~21%).

The second mode of generation of vapor at lower pressure provides that the organic liquid is withdrawn in liquid form in the most convenient point in the system; and injected into the labyrinth, where it tends to evaporate because it absorbs heat from the hot walls of the turbine, but especially by the vapor already present in the chamber: the liquid impacting against the rotating surfaces tends to be distributed in form of drops that increase the thermal exchange surface with the surrounding vapor.

The evaporating fluid increases its volume and the pressure inside the chamber, limiting the leakage. The advantage compared to the previous mode is that it uses fluid in the liquid state and not vapor, hence with a lower energy content. The disadvantage may be represented by the tensional stress that may be created in the material forming the stator and rotor components in localizing lowering of temperature due to the introduction of cold liquid. Furthermore, the organic fluid may leak out of the labyrinth still in the liquid state, segregating in certain areas of the turbine or impacting on downstream blades.

The third mode of the vapor generation instead takes its cue from what has just been described as a possible disadvantage of the previous mode: the liquid is injected in the chamber delimited by the labyrinth, so as to spread, in form of droplets; part of the fluid evaporate, while another part remains in a liquid form. This mixture of vapor and drops will tend to flow more laboriously through the labyrinths games, limiting the leakage.

For example, the labyrinth L1 is typically affected by a difference pressure highly above the critical pressure ratio, then the vapor that leaks will have a sonic speed equal to that in the vicinity of the minimum passage section. If to the vapor liquid droplets are united, these obstruct the passage of vapor in the vicinity of the throat, reducing the passage area for the vapor.

The presence of drops decreases the vapor leakage, but the total flow exits the labyrinth increases because the liquid phase is approximately a thousand times more dense than vapor: in general you can still have an advantage due to the fact that the liquid phase is energetically "poorer".

In addition to the modes of the invention, as described above, it is to be understood that there are many further variants. It must be understood that these modes of implementation are only illustrative and do not limit the invention or its applications, nor its possible configurations. On the contrary, although the description above makes it possible to man craft of the implementation of the present invention at least one of its second configuration example, it should be understood that numerous variations are conceivable of the components described, without moving away from the object of the invention, as defined in the appended claims, interpreted literally and/or according to their legal equivalents.

The invention relates to systems that operate according to an organic Rankine cycle (ORC) or traditional water vapor, in particular to the case where the expansion ratio around the object considered is at least 1.5, in a manner that the energetic content of the vapor injected to the labyrinth becomes significantly lower than that of the main flow in correspondence of that stage.

The invention claimed is:

1. A method for reducing the leakage of an organic working fluid operating within a turbine (10) of an Organic Rankine Cycle system, the method comprising the injection of a fluid flow rate (Q) into a volume (I) through at least one conduit (21, 22) passing through the housing (20) of the turbine, at a static outlet pressure (PI1), lower than a total pressure (P1) upstream of a turbine stage wherein the injection takes place and located near of at least one labyrinth seal (L1, L11) of at least one stage of the turbine (10), and wherein said fluid flow rate (Q) having an initial exergetic content lower than an initial exergetic content of the organic working fluid located inside the turbine, said fluid flow rate (Q) is flowing through said labyrinth seal (L1, L11) to oppose a leak of pressure;

and wherein said volume (I) in which the injection of the fluid flow rate (Q) takes place, is accommodated at one stage of the turbine (10) different from the first stage and is at a lower static pressure with respect to the total pressure upstream of the corresponding turbine stage in which the injection takes place;

and wherein said injection of the fluid flow rate (Q) is taking place through a conduit (21, 22) passing within body (20) of the turbine;

and wherein in case the pressure of the fluid flow rate (Q) is higher than the total pressure (PI1), there will be a flow also through labyrinth seal (L11), directed towards the turbine's blades;

and wherein in case the pressure of the fluid flow rate (Q) is lower than the total pressure (PI1), there will be a flow also through labyrinth seal (L11), directed towards a condenser (3);

and wherein in case the pressure of the fluid flow rate (Q) is equal to the total pressure (PI1), there will be no flow also through labyrinth seal (L11), opposing a leak of pressure.

2. The method according to claim 1, wherein said volume (I) is supplied between the two labyrinths (L1) and (L11) of the first stage of the turbine (10).

3. The method according to claim 1, wherein said fluid flow rate (Q) is injected directly inside a first labyrinth seal (L1) to a pressure downstream of a first stator, through a conduit (21, 22) passing within body (20) of the turbine.

4. The method according to claim 1, wherein said fluid flow rate (Q) is injected upstream of the first labyrinth seal (L1), through a conduit (21, 22) passing within body (20) of the turbine.

5. The method according to claim 1, wherein said fluid flow rate (Q) is injected into the volume (1) upstream of the first labyrinth seal (L1) and downstream of a second labyrinth seal (L11), through a conduit (21, 22) passing within body (20) of the turbine.

6. The method according to claim 1, wherein said flow rate (Q) of the organic working fluid is injected as vapor at a pressure level as the one present downstream of a first stator of said turbine (10).

7. The method according to claim 1, wherein said flow rate (Q) of the organic working fluid is injected in a liquid state.

8. The method according to claim 7, wherein the flow rate (Q) of the injected organic working fluid is in liquid state and vaporizes as vapor in correspondence of said at least one labyrinth seal (L1, L11) absorbing heat from hot walls of said turbine (10) and by vapor already present inside said volume (I) jn correspondence to the first stage of the turbine (10); and wherein said working fluid in liquid state is impacting against rotating surfaces and is distributed in form of drops increasing a thermal exchange surface with surrounding vapor; and wherein said working fluid is evaporating thus increasing its volume and its pressure inside said volume (I), limiting a leakage.

9. The method according to claim 7, wherein said flow rate (Q) of the organic working is in liquid state and is transformed into a two-phase mixture in correspondence to said at least one labyrinth seal (L1, L11); wherein part of said organic working fluid in liquid state is in form of droplets, wherein part of a mixture of said fluid evaporates, while another part remains in a liquid form; and wherein said mixture of vapor and drops will tend to flow more laboriously through the labyrinths (L1, L11) being more dense than vapor, thus limiting a leakage;

and wherein leaking vapor will have a sonic speed equal to that in the vicinity of said labyrinth passage, while vapor liquid droplets are close to each other, obstructing vapor passage.

10. The method according to claim 9, wherein said flow rate (Q) of the organic working fluid is tapped downstream of a recuperator (2) of an organic Rankine cycle (ORC) plant.

11. The method according to claim 10, wherein said flow rate (Q) of the organic working fluid is tapped in liquid phase downstream of the recuperator (2), then is laminated and finally is vaporized into one additional heat exchanger (6).

12. An expansion turbine (10) comprising:

a housing (20) steadily connected with at least a first stator stage (S1);

at least one disk (30) steadily connected with at least a first rotor stage (R1);

at least one labyrinth seal (L1, L11) located downstream of said at least one first stator stage;

and further comprising at least one conduit (21, 22) passing through the housing (20) of the turbine, that fluid connects the exterior of the turbine with the inner volume (I) of the turbine and that is configured to inject a flow rate (Q) of a fluid in correspondence to said at least one labyrinth seal (L1, L11), said fluid flow rate (Q) having an initial exergetic content lower than an initial exergetic content of the organic working fluid located inside the turbine and flowing through said labyrinth seal (L1, L11), said fluid flow rate (Q) having a static pressure lower than the total pressure (P1) upstream of a turbine stage where the injection takes place and has an initial exergetic content lower than the initial exergetic content of the organic working fluid located inside the turbine and flowing through said labyrinth seal (L1, L11) to oppose a leak of pressure;

and wherein said volume (I) in which the injection of the fluid flow rate (Q) takes place, is accommodated at one stage of the turbine (10) different from the first stage and is at a lower static pressure with respect to the total pressure upstream of the corresponding turbine stage in which the injection takes place;

and wherein said injection of the fluid flow rate (Q) is taking place through a conduit (21, 22) passing within body (20) of the turbine;

and wherein in case the pressure of the fluid flow rate (Q) is higher than the total pressure (PI1), there will be a flow also through labyrinth seal (L11), directed towards the turbine's blades;

and wherein in case the pressure of the fluid flow rate (Q) is lower than the total pressure (PI1), there will be a flow also through labyrinth seal (L11), directed towards a condenser (3);

and wherein in case the pressure of the fluid flow rate (Q) is equal to the total pressure (PI1), there will be no flow also through labyrinth seal (L11), opposing a leak of pressure.

13. The expansion turbine according to claim 12, wherein said turbine is configured so that fluid flow rate (Q) is injected through a first conduit (22) exactly inside the first labyrinth seal (L1).

14. The expansion turbine according to claim 12, wherein said fluid flow rate (Q) is injected through the first conduit (22) upstream of the first labyrinth seal (L1).

15. The expansion turbine according to claim 12, wherein said fluid flow rate (Q) is injected through a conduit (21) in the volume (I) upstream of the first labyrinth seal (L1) and downstream of a second labyrinth seal (L11).

16. An Organic Rankine Cycle (ORC) system, comprising:

a recuperator (2) configured to transfer heat from an organic working fluid in a vapor phase to the same organic working fluid in a liquid phase; and for recovering heat downstream of a turbine and upstream of a condenser (3);

a condenser (3) downstream of the recuperator (2) configured to transfer heat from the organic working fluid in a vapor phase to a cold source (SF), returning the organic fluid in a liquid state;

pump (4) downstream of the condenser (3) configured to feed the organic working fluid in a liquid phase to a heat exchanger (5) at a predetermined pressure (PI);

heat exchanger (5), configured for heating, vaporizing and even overheating the organic working fluid by means of a hot source (SC); said exchanger (5) exchanges heat between organic fluid in liquid phase which is pumped by the pump (4); and exchanges organic fluid in a vapor phase from the turbine 10 is toward the condenser (3); said heat exchanger (5) further comprising a pre-heater, an evaporator and a super-heater;

an expansion turbine (10) configured to expand the organic working fluid in a vapor phase from a pressure (PI) to a lower pressure (Pcond);

and wherein said volume (I) in which the injection of the fluid flow rate (Q) takes place, is accommodated at one stage of the turbine (10) different from the first stage and is at a lower static pressure with respect to the total pressure upstream of the corresponding turbine stage in which the injection takes place;

and wherein said injection of the fluid flow rate (Q) is taking place through a conduit (21, 22) passing within body (20) of the turbine;

and wherein in case the pressure of the fluid flow rate (Q) is higher than the total pressure (PI1), there will be a flow also through labyrinth seal (L11), directed towards the turbine's blades;

and wherein in case the pressure of the fluid flow rate (Q) is lower than the total pressure (PI1), there will be a flow also through labyrinth seal (L11), directed towards a condenser (3);

and wherein in case the pressure of the fluid flow rate (Q) is equal to the total pressure (PI1), there will be no flow also through labyrinth seal (L11), opposing a leak of pressure;

and wherein said turbine (10) comprises:

a housing (20) steadily connected with at least a first stator stage (S1);

at least one disk (30) steadily connected with at least a first rotor stage (R1);

at least one labyrinth seal (L1, L11) located downstream of said at least one first stator stage;

and further comprising at least one conduit (21, 22) that fluid connects the exterior of the turbine with the inner volume (I) of the turbine and that is configured to inject a flow rate (Q) of a fluid in correspondence to said at least one labyrinth seal (L1, L11), said fluid flow rate (Q) having an initial exergetic content lower than the initial exergetic content of the organic working fluid located inside the turbine and flowing through said labyrinth seal (L1, L11).

17. The Organic Rankine Cycle system according to claim 16, comprising an additional heat exchanger (6), downstream of the heat exchanger (5) and configured to vaporize by means of the hot source (SC) a flow rate (Q) of the organic working fluid, tapped in liquid phase downstream of the pump (4) or the recuperator (2).

18. The Organic Rankine Cycle system according to claim 17 wherein said additional heat exchanger (6) is crossed by a fraction of the hot source (SC) flow rate.

19. The Organic Rankine Cycle system according to claim 16, wherein said additional heat exchanger (6), placed in parallel to at least a portion of the heat exchanger (5) and configured to vaporize by means of the flow rate (Q1) of the hot source (SC) a flow rate (Q) of the organic working fluid, poured in a liquid phase downstream of the pump (4) or of the recuperator (2).

20. The Organic Rankine Cycle system according to claim 16, wherein said turbine (10) is characterized by a fluid flow rate (Q) being injected through a first conduit (22) exactly inside a first labyrinth seal (L1).

21. The Organic Rankine Cycle system according to claim 16, wherein said turbine (10) is characterized by a fluid flow rate (Q) being injected through a first conduit (22) upstream of a first labyrinth seal (L1).

22. The Organic Rankine Cycle system according to claim 16, wherein said turbine (10) is characterized by a fluid flow rate (Q) being injected through a second conduit (21) in a volume (I) upstream of a first labyrinth seal (L1) and downstream of a second labyrinth seal (L11) through a conduit (21, 22) passing within body (20) of the turbine.

* * * * *